United States Patent [19]

Maddock, Jr. Alfred W.

[11] Patent Number: 4,483,187

[45] Date of Patent: Nov. 20, 1984

[54] SURFACE READOUT DRILL STEM TEST CONTROL APPARATUS

[75] Inventor: Alfred W. Maddock, Jr., Duncan, Okla.

[73] Assignee: Halliburton Company, Duncan, Okla.

[21] Appl. No.: 454,297

[22] Filed: Dec. 29, 1982

[51] Int. Cl.[3] ..... E21B 47/00

[52] U.S. Cl. ..... 73/151

[58] Field of Search ..... 73/151, 152, 155; 367/81; 340/856, 857, 861

[56] References Cited

U.S. PATENT DOCUMENTS 3,374,459 3/1968 Rabson et al. ..... 340/856

4,365,506 12/1982 Hyde ..... 73/151

*Primary Examiner*—Jerry W. Myracle

*Attorney, Agent, or Firm*—William J. Beard

[57] ABSTRACT

A surface readout (SRO) system for use with a wire line drill stem testing apparatus is disclosed. More particularly, the preferred and illustrated embodiment sets forth control circuitry for such a system. At the time that a well has been drilled and a potentially productive formation has been located, test apparatus incorporating a probe assembly is lowered on a wire line. The probe assembly incorporates a latch mechanism and a motorized tester valve opening apparatus. This disclosure sets forth a control system for the latch to fasten the probe in the downhole apparatus for conducting pressure and temperature testing of the formation to determine its flow and production potential. Moreover, a motor control circuit is also included to open the tester valve. These devices are located in the probe and are triggered into operation by signals transmitted on the wire line to the probe.

13 Claims, 3 Drawing Figures

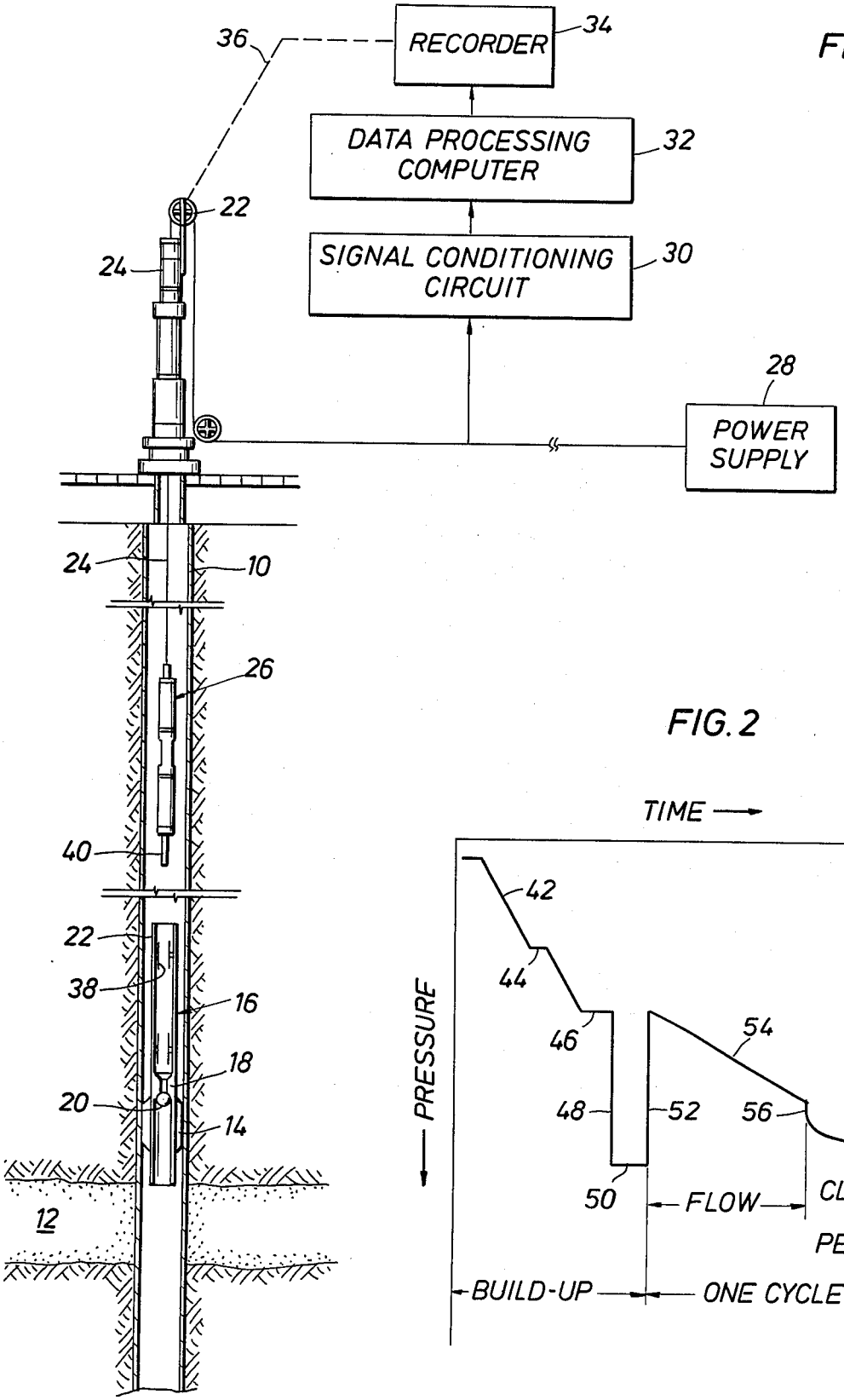
FIG. 1
FIG. 2
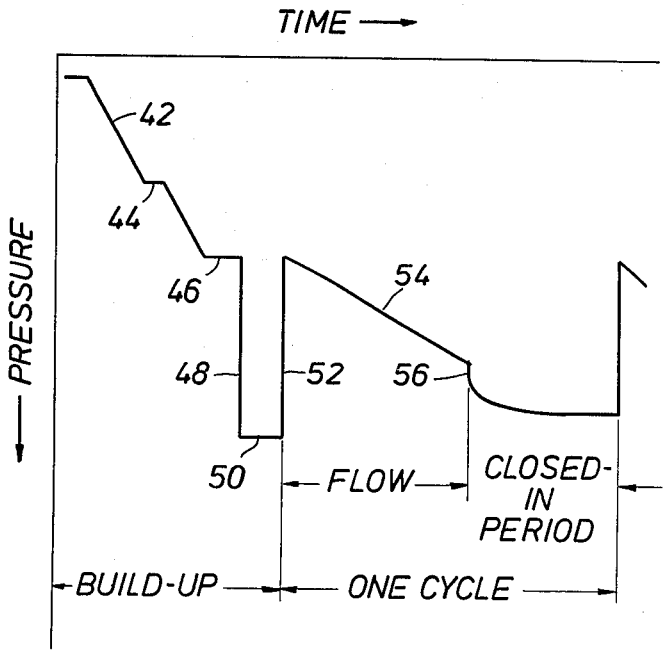

SURFACE READOUT DRILL STEM TEST CONTROL APPARATUS

BACKGROUND OF THE DISCLOSURE

In the drilling of an oil well through a production zone which is thought to be suitable for production, it is often desirable to run a test of the production zone for the express purpose of determining production potential. This typically occurs at the stage after the well has been drilled but all of the production equipment has not been installed. The formation of interest is typically packed off by setting isolation packers above and below the zone of interest. A test string is installed above the zone and incorporates a receptacle for receiving a surface readout probe which is lowered on a wire line. The initial condition finds the production zone of interest shut in, that is, without flow from the zone to the surface. This investigative step is usually implemented after packing off the production zone so that there is no flow in the open hole, and pressure control apparatus is installed at the well head. Typically, this includes a lubricator and blow out preventer assembly. A wire line is fed through the production equipment at the surface and is lowered into the well to support a probe on the wire line. The wire line is run into the well to land the probe in a cooperative fashion at the test string equipment installed in the well.

Through the use of the present invention, the formation of interest is produced and flowed for a regulated interval. Certain pressures and temperatures are recorded. while the probe remains engaged with the test string equipment in the well, data is collected by the probe and is fed up the wire line. This data is delivered to the surface and a plot is formed of pressure against time. Such a plot has great value for the purpose of determining through a Horner straight line plot whether the test flow has had sufficient duration, leading to the determination of the well potential for oil or gas production.

One of the handicaps which is encountered is that fairly ruggedized equipment must be used and operated through a high pressure lubricator. This typically involves the use of an armored wire line as small as 7/32 inches to reduce the size of the cross sectional area presented under pressure to the high pressure lubricator. This is typically a single center conductor armored cable. The wire line is required to support the weight of the probe and to operate the probe with the test string equipment located downhole. Equally important, data is collected by transfer along the wire line. The center conductor of the wire line is therefore a common conductor which is used to transfer data and power. The wire line is used as a single conductor for data transfer in both directions and to provide electric power for operation of the probe. A complete circuit is obtained utilizing the armored sheath of the single conductor wire line. This single conductor therefore is connected to several components of equipment in the probe with a goal of of sorting out the signals which are transferred to and from the downhole equipment and the surface equipment.

DESCRIPTION OF THE PRIOR ART

One device of general interest to this disclosure is U.S. Pat. No. 4,157,535 of Balkanli. This patent sets forth a three phase pump motor utilizing a three phase power cable. Moreover, there are signals transmitted downhole including a frequency encoded signal. Another patent of interest is U.S. Pat. No. 3,540,030 of Hartz. Control signals are superimposed on a power signal, and the control signals are counted by an electronic counter. The counter in turn operates a relay.

An array of Zener diodes is set forth in U.S. Pat. No. 3,932,714 of Guimier. Voltage levels are sensed and sorted by the Zener diodes. U.S. Pat. No. 3,412,266 of Tarico is of some interest in setting forth an FET latching circuit responding to a positive control voltage pulse. There is a separate terminal for the power for this circuit, and a separate signal input lead. U.S. Pat. No. 3,586,879 of Ford discloses a circuit having an output load circuit responsive to a supply voltage between two set threshold values. It does not however, disclose a remote latching system of the sort set forth in this disclosure.

This disclosure is directed to a surface readout (SRO) with connected probe suspended on a typical wire line (therefore constituting a single conductor pair) particularly utilizing the wire line to physically support the tool, transfer electric power from the surface equipment to the probe for its operation, transmit control signals from the surface to the probe to trigger its operation in a complex sequence, and to also deliver data measured by the probe back to the surface, all through the common wire line. The present apparatus thus enables the surface readout equipment to obtain the data necessary; after suitable data manipulation, a formation test procedure determines whether or not the formation produces adequately to justify the added cost to complete the well and to place the well on line. This apparatus particularly enhances the equipment that makes testing possible and also accomplishes this through a single wire line conductor. This is quite advantageous because the circumstances of use in operation are quite rugged, and a multistrand conductor system suspended in the wellbore runs the risk of back blow through the lubricator because of its relatively large area cross section.

BRIEF DESCRIPTION OF THE INVENTION

The foregoing describes briefly the problem which has been encountered by the disclosed apparatus. The present invention is therefore summarized as control and operating circuitry incorporated in a surface readout probe system adapted to be lowered in a wellbore on a single conductor armored wire line wherein control signals (as well as other signals and power levels) are transmitted along the wire line. Control signal responsive apparatus is also set forth, in particular a mechanism whereby the latches in the probe are actuated for securing the probe in the test string equipment. In similar fashion, power for operation of a motor is also included so that the tester valve assembly can be operated. All of this assists formation testing to obtain formation pressure and temperature under flow conditions to determine whether or not the producing zone is commercially attractive.

BRIEF DESCRIPTION OF THE DRAWINGS

So that the manner in which the above recited features, advantages and objects of the present invention are attatined and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 discloses a surface readout probe and associated drill stem testing apparatus in a well which is undergoing testing;

FIG. 2 is a chart of pressure and time which is typical of the testing procedure applied to the formation undergoing test with the apparatus shown in FIG. 1.

DETAILED DESCRIPTION OF THE PREFERRED EMBODIMENT

Figure 3:
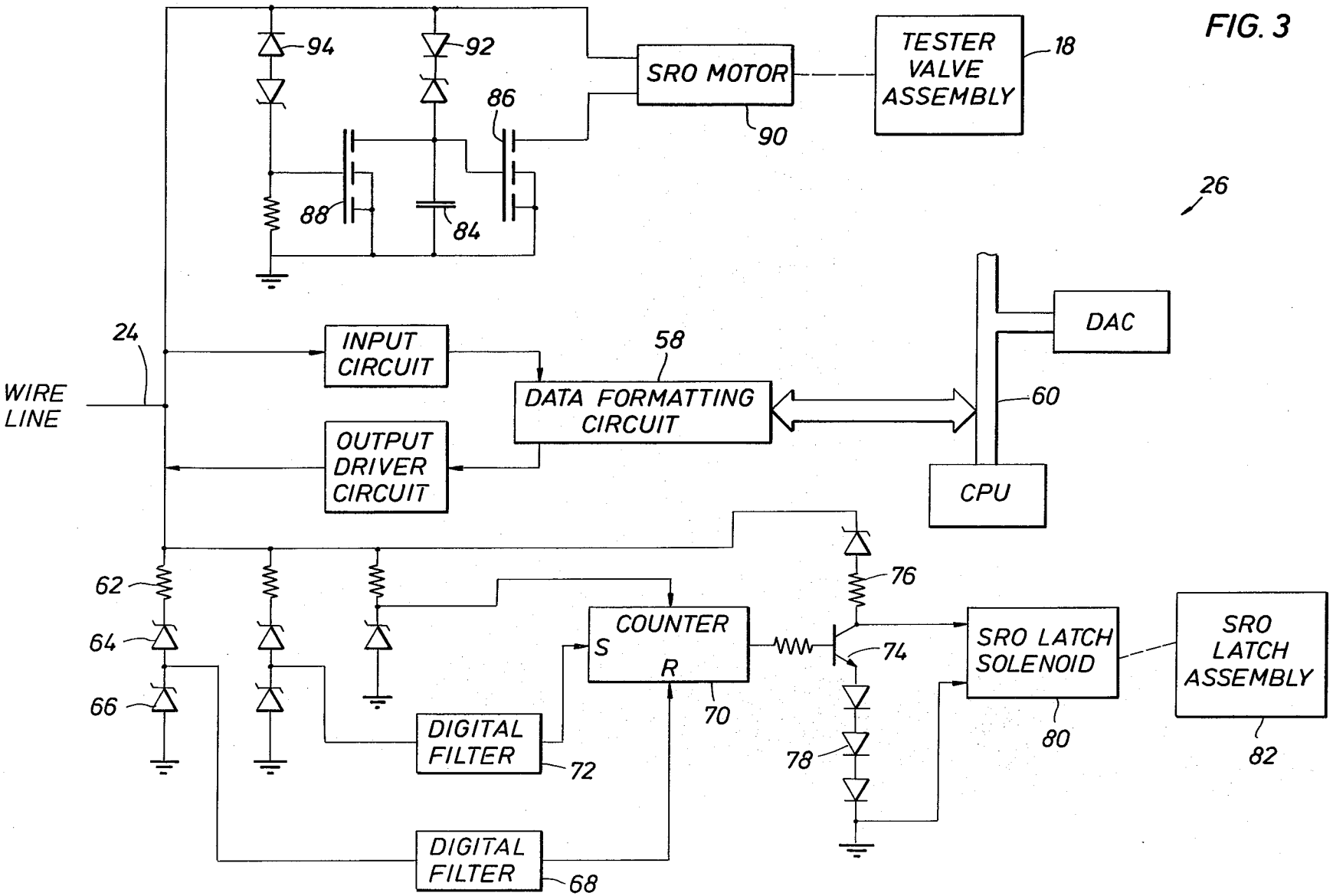
FIG. 3 is a schematic block diagram of apparatus which is included in the probe lowered into wellbore on the wire line and which apparatus operates the equipment with the probe.

Attention is first directed to FIG. 1 of the drawings. In FIG. 1, a well 10 has been completed through a formation 12 which is believed to be capable of producing oil or gas in commercial quantities. The formation 12 is isolated by means of a packer (not shown) below the formation, and it is also isolated by a packer 14 above. The packer 14 supports an assembly known as the test string equipment at 16. Briefly, this comprises a narrow passage 18, adjacent to a valve element 20 having the form of a valve which is forced against the passage 18 to seal the passage, and an alignment receptacle 22. This structure supported on the packer 14 isolates the zone 12 so that the zone can be tested.

This SRO apparatus can be placed in a well that is cased or in open hole. Typically, such a test is run after the well has been drilled but before completion has been finished. Typically, it is run to determine whether or not the formation 12 can be produced in commercial or paying quantities, and the production rate is therefore determined by the testing procedure to be described below. Decisions regarding completion of the well or abandonment and plugging are typically made at this stage after testing.

For purposes of testing, pressure control equipment is located at the wellhead. Typically, this includes a sheave wheel 22 for feeding a wire line 24 into the well. The wire line is introduced through a high pressure lubricator 24 cooperative with a blowout preventer (not shown) and other equipment to maintain control over the well while introducing the wire line equipment into the well. Control over the well is maintained at all times through the testing procedure by the use of the high pressure lubricator, blowout preventer and other wellhead control apparatus. The wire line 24 supports the probe assembly 26 to be described below. The probe assembly is lowered into the well on the wire line for conducting the test of interest.

The wire line is typically provided with an armored sheath which serves as the return conductor of a circuit. In other words, the wire line is a single conductor pair. It is typically a heavy duty wire line, often in the range of about 7/32 inch in diameter. The wire line is the sole means of support for the probe 26.

The wire line is connected to a power supply 28 and to a signal conditioning circuit 30. That circuit is then connected to a data processing computer 32 which in turn connects with a recorder 34. If desired, the depth of the probe in the well is determined by conventional depth indicating apparatus 36 (indicated by a dashed line) operated by the sheave wheel 22. This data is provided to the recorder 34 to be stored as appropriate. The wire line is supplied to a powered supply reel for storage and raising and lowering purposes.

The probe 26 supports a temperature sensing device. It also incorporates a pressure gauge. In addition, the probe 26 has a set of extendable latches. The latches are constructed and arranged to latch to the internal shoulder 38 in the probe receptacle 22. This fastens or holds the probe in location when it is received at the proper position in the receptacle 22. The probe also supports a probe tip or stinger 40. The probe tip 40 is sized and proportioned so that it extends into the apparatus below the receptacle and upsets the tester valve 20. That is, it opens the tester valve. It is preferably extendable and, is motorized for extension. When it extends, it opens the closed valve, and this permits oil or gas to flow from the formation 12 below the packer 14. The probe also carries equipment for measuring the pressure and temperature at the formation. Through these measurements, the production rate and potential of the well can be determined.

The test procedure which is carried out by the apparatus of this disclosure occurs over a period of time. In FIG. 2 of the drawings, a chart of pressure verus time is illustrated. This is representive of the data typically observed through the use of the surface readout probe cooperative with the drill stem testing system. In FIG. 2 of the drawings, the initial condition assumes that the well is flowing from the formation 12. The flow path is restricted, pressure below the packer 14 begins to increase. Increasing pressure is thus reflected at 42 in FIG. 2. It should be recalled that flow from the well can be controlled at two locations; one control is closing the valve 20. Separate from this, another point of control for the well is the wellhead equipment at the surface. Flow from the well is permitted at a controlled rate by means of the wellhead equipment. The probe is thoroughly washed with the oil and gas produced from the formation 12, and this continues for an interval at 44. This interval equalizes the temperature of the probe. This temperature equalization brings the probe to the temperature of the produced oil and gas.

The flow is reduced at the wellhead to enable the probe to be admitted to the receptacle 22. The probe must be stabbed into the receptacle 2 against the flow, and this flow typically prevents the probe from entering the receptacle 22 and achieving proper alignment, and fully latching in. As the flow is reduced at the wellhead, the flow through the receptacle 22 is also reduced, and the pressure observed at the formation 12 continues to increase. When the probe is received within the receptacle 22, it is latched, and this is indicated at 46. It is latched and then operated to enable the tester valve 20 to completely close. The pressure then markedly increases at 48. The pressure increases to some level which will be termed formation pressure 50. This is held for a predetermined time interval. Once pressure is stabilized, the first cycle of operation can be initiated.

The first cycle of production is achieved by opening the wellhead equipment to enable flow from the well. Through the use of motorized equipment to be described, the lower probe tip 40 is extended, thereby forcing open the tester valve 20 to flow. The pressure markedly drops at 52 to indicate that the valve 20 has been opened. Formation fluid below the packer 14 is relieved by flow. Flow is then permitted in a controlled fashion. For instance, the well may be produced through a sized choke to control the production rate.

Whatever the circumstances, it is produced for a predetermined time interval. The flow continues for an interval at which time the pressure begins to build up at 54. The increase 54 of pressure is dependent in part on the depth of the well, the size of the passage at 18, the choke installed at the wellhead, and other scale factors. Eventually, the pressure observed at the tester valve increases until the well is again closed in. This occurs at 56. Pressure again increases toward some maximum. This pressure is sustained for an interval and the cycle is again repeated.

One cycle of operation is shown in FIG. 2. The cycle of operation is repeated beginning with the sudden drop in pressure at 52. This drop in pressure is accomplished to initiate the cycle of data which is shown in FIG. 2. This is repeated for several cycles; after the data have been recorded, they are then used in a multiple regression analysis to compute static reservoir pressure. These data are also used to define a Horner plot. This information thus enables interpretation of the data for the purpose of determining whether or not the formation 12 justifies commercial production.

Attention is next directed to FIG. 3 of the drawings which sets forth certain of the apparatus in the probe 26. Briefly, the wire line 24 is shown connected to the apparatus. The wire line 24 is a heavy duty wire line for supporting the tool. In addition, it is a single conductor pair. Ground is indicated in FIG. 3, keeping in mind that the ground return is through the armored sheath of the wire line 24. The wire line is connected to suitable input and output circuits which in turn communicate with a data formatting circuit 58. The circuit 58 is connected with a bus 60 which communicates with suitable digital data handling components which convert the data at the probe. The operation of this equipment is noted to provide the context in which the remainder of the equipment shown in FIG. 3 will be described.

The wire line 24 is connected as both a power lead and data input lead. It is input to control circuitry also shown in FIG. 3. This circuitry includes a resistor 62, a serially connected pair of Zener diodes 64 and 66. They define an input voltage level for a digital filter 68. The digital filter is input to a counter 70. In like fashion, there is an additional digital filter 72 also input to the counter. The two digital filters function in a similar manner. They differ only in the voltage levels input to them. Briefly, pulsed tone burst inputs on the line 24 are fed to the two digital filters 68 and 72. If the frequency is matched at the digital filters, they form output pulses of a suitable amplitude. The amplitude is determined by the input circuit, namely the series resistor with the two Zener diodes. Assume for purposes of description that 24 kilohertz operates the digital filter 72 while the digital 68 is operated by 28 kilohertz. Assume further that such tone bursts are placed on the line. If so, they provide input pulses to the counter 70. The counter 70 is provided with set and reset input terminals. FIG. 3 also shows a suitable connection with the wire line 24 which provides B+ or operating voltage to the counter for its operation. The counter, provided with set and reset signals described above, forms a latching signal. This will be described below.

The counter 70 drives the base of a transistor amplifier 74. While a single transistor has been shown schematically, it is preferable to use a cascade of transistors defining a Darlington amplifier. The transistor amplifier 74 is a relatively large, heavy duty transistor. In the collector, there is a suitable collector load resistor 76, and several serial diodes 78 connected in the emitter. This defines a pair of output terminals which are connected to a SRO latch solenoid 80. The latch solenoid is provided with power depending on the operative state of the Darlington transistor amplifier 74. The transistor 74 is switched off or on. Switching of the transistor 74 controls current flow through the latch solenoid 80. Current flowing through the solenoid 80 operates the surface readout probe latch assembly 82. That assembly 82 incorporates the latches which secure the probe 26 in the receptacle 22. When the latches are extended, the probe is held in position. When the latches are retracted, the probe is free to be removed. The circuitry connected to the latch solenoid 80 manipulates the latches to enable them to fasten, thereby holding the probe in place.

In FIG. 3, it will also be observed that the wire line 24 is connected to a control circuit for the SRO motor 90. The motor 90 operates the tester valve assembly by extending the probe tip. Briefly, the control circuit incorporates a storage capacitor 84. Charge is accumulated on the storage capacitor. DC voltage on the line 24 is connected to the SRO motor 90. Current however does not flow because the field effect transistor (FET) 86 is switched off. This keeps the motor 90 turned off. The FET 88, if conductive, discharges the capacitor 84. When discharge occurs, the charge on the capacitor goes close to ground and that in turn switches the FET 86.

This circuitry includes means for placing a charge on the capacitor 84. Assume that a positive pulse is applied over the wire line. Such a pulse is passed by the diode 92. The diode 92 passes a charge which will charge the capacitor, thereby switching the FET transistor 86 on and permitting the motor 90 to operate. A negative going pulse is passed by the diode 94. That forms a pulse which is applied to the FET 88. The FET transistor 88 is normally held in the off condition. A negative pulse will be recognized by the diode 94, switching the transistor 88 on. Thus, it will be observed that the control transistor 88 with the power transistor 86 operates the motor 90.

Briefly, the sequence is as follows; a positive going pulse is delivered on the conductor 24. This positive pulse is passed by the diode 92 to charge the capacitor 84 sufficiently to switch the transistor 86 on. This causes current to flow through the load connected to the transistor 86. This operates the motor 90. The motor is operated for an interval determined by the spacing of the positive going pulse which starts operation and the subsequent negative going pulse which turns it off. Suppose that the motor is required to be operated for ten seconds. In that event, pulses of the proper magnitude are applied ten seconds apart. That is, there is first a positive pulse to switch the motor on and then a negative going pulse to switch it off. A spacing of ten seconds might be suitable for one operation. Of course, the motor can be operated for different intervals are determined by the time spacing of the operative pulses.

Directing attention now to the probe 26, it will be observed that the probe is lowered into the receptacle. Fitting loosely in the receptacle, it is then positioned so that the latches can be extended to anchor the probe temporarily. This is achieved through the SRO latch solenoid 80 shown in FIG. 3. After it has been latched in place, the motor can then be operated. The motor 90 is provided with power in the manner described above so that mechanical movement can be accomplished as a preliminary to obtaining the necessary pressure and temperature data from the formation. This data is obtained downhole but it is transferred to the surface on the single conductor pair available (the wire line 24 and its surrounding armor sheath), thereby enabling the surface operator to get sufficient data and information to know whether or not the well can produce adequately from the formation 12.

While the foregoing is directed to the preferred embodiment the scope of the invention is determined by the claims which follow.

What is claimed is:

1. A control system in a wire line supported tool adapted to be lowered into a well to test for formation flow of oil or gas, an apparatus which comprises:

(a) a wire line adapted to be lowered into a well;

(b) a tool supported on said wire line;

(c) said wire line including a metallic sheath and comprising with said sheath a single center conductor;

(d) electrically powered means connected to said wire line to be furnished electrical power supplied to said tool along said wire line, said electrically powered means being switched under control of a circuit means, said circuit means comprising:

(1) input means connected to said wire line for responding to an input pulse received from said wire line;

(2) reset means connected to said wire line for recognizing a reset pulse transmitted on said wire line and forming a reset pulse;

(3) said reset means forming a reset pulse after said input pulse, said pulses triggering operation of said electrically powered means to operate said tool in the well; and (4) counter means connected to said input means and said reset means, said counter means forming an output signal indicative of an input pulse and terminating on a reset pulse, said counter means operating to form the output signal thereof for an interval determined by spacing of said input and reset pulses.

2. The apparatus of claim 1 including a switching transistor means connected to said counter means output signal to switch between two operative states, said switching transistor means being connected to control current flow to said electrically powered means.

3. The apparatus of claim 2 wherein said wire line simultaneously provides DC power for operation of said electrically powered means, and said switching transistor means is connected therewith across said wire line to apply controllable current flow to said electrically powered means.

4. The apparatus of claim 3 including load means for said switching transistor means.

5. The apparatus of claim 3 including a Darlington transistor comprising said switching transistor means.

6. The apparatus of claim 3 including a B+ voltage provided for said counter means from said wire line by a voltage forming circuit.

7. An electrical control system including an electronic latching relay for use on a wire line suspended formation tester tool, the electronic latching relay comprising:

(a) a wire line adapted to be lowered into a well;

(b) a tool supported on said wire line;

(c) control means cooperative with control pulses applied on said wire line supporting said tool wherein a positive pulse and a negative pulse are input to said tool on said wire line, the control means comprising:

(1) transistorized switch means serially connected with an electrical load and having terminals, said switch means and said electrical load being connected in series across said wire line and adapted to receive power for operation thereof from said wire line;

(2) a charging capacitor connected to a terminal of said transistorized switch means for providing a charge thereon to operate said transistorized switch means; and (3) means for discharging said charging capacitor including a voltage divider, and wherein said voltage divider is polarized to recognize a negative going pulse on said wire line which negative going pulse discharges said capacitor and switches said transistorized switching means off; and (d) wherein said electrical load comprises an electrically powered motor means supported by said tool for operation of said tool.

8. The apparatus of claim 7 wherein said transistor switch means comprises:

a serially connected FET having two operative states, one state being conductive and the other state being non-conductive.

9. The apparatus of claim 8 wherein said charging capacitor is charged by a positive pulse on said wire line passed by a blocking diode.

10. The apparatus of claim 9 including a second blocking diode connected with opposite polarity to said wire line, said second diode being connected to a biased switching transistor, said transistor being connected to discharge said charging capacitor, and said second diode comprises a portion of said voltage divider.

11. The apparatus of claim 9, including a serial resistor connected to said second diode.

12. The apparatus of claim 7 including an FET comprising said transistorized switch means, and having an input thereof connected to said charging capacitor, said FET further having source and drain connections serially connected with said motor means across said wire line to operate said motor means on applying an operative voltage across said wire line.

13. The apparatus of claim 12 wherein said wire line is connected to said tool to support said tool, and is also connected to said motor means to simultaneously furnish electrical power thereto for operation.

* * * * *